US006672365B2

(12) United States Patent
Therrien

(10) Patent No.: US 6,672,365 B2
(45) Date of Patent: Jan. 6, 2004

(54) CORNER FOR SCREEN

(76) Inventor: Gerard Therrien, 400 des Chutes, St-Nicolas, Quebec (CA), G7A 1E7

( * ) Notice: Subject to any disclaimer, the term of this patent is extended or adjusted under 35 U.S.C. 154(b) by 49 days.

(21) Appl. No.: 10/014,752

(22) Filed: Dec. 10, 2001

(65) Prior Publication Data

US 2002/0092632 A1 Jul. 18, 2002

Related U.S. Application Data

(63) Continuation-in-part of application No. 09/843,654, filed on Apr. 26, 2001, now abandoned.
(60) Provisional application No. 60/200,136, filed on Apr. 27, 2002.

(51) Int. Cl.[7] ..... E06B 3/00
(52) U.S. Cl. ..... 160/369; 160/381; 49/501
(58) Field of Search ..... 160/369, 371, 160/376, 381; 49/504, 501, 463, 465, 70; 52/656.5, 656.6, 656.7, 656.9

(56) References Cited

U.S. PATENT DOCUMENTS 1,852,866 A * 4/1932 Weitzel ..... 160/381
1,918,660 A * 7/1933 Norquist et al. ..... 160/376
2,519,168 A * 8/1950 Arenwald et al. ..... 160/369
2,597,484 A * 5/1952 Heilig ..... 160/381
2,636,458 A * 4/1953 Harris ..... 108/30
2,870,882 A * 1/1959 Tolman ..... 189/75
2,989,788 A * 6/1961 Kessler ..... 160/381
3,137,901 A * 6/1964 Malachowski et al. ... 49/501 X
4,195,681 A * 4/1980 Douglas et al. ..... 160/371
4,570,406 A * 2/1986 DiFazio ..... 52/656.7
5,431,211 A * 7/1995 Guillemet ..... 160/381
5,450,701 A * 9/1995 White ..... 52/656.9
5,473,853 A * 12/1995 Guillemet et al. ..... 160/381 X
5,547,011 A * 8/1996 Dotson et al. ..... 160/381
5,875,602 A * 3/1999 Lappin et al. ..... 52/656.5 X

* cited by examiner

*Primary Examiner*—David Purol
(74) *Attorney, Agent, or Firm*—Eric Fincham

(57) ABSTRACT

A spring member for use in retaining a screen within a window frame, the spring member having an elongated dome portion, an upwardly extending portion formed within the dome portion and designed to fit within a recess in a window. The spring members ideally are suited for window frames made using corner members.

8 Claims, 6 Drawing Sheets

CORNER FOR SCREEN

The present application is a Continuation-in-Part application of U.S. patent application Ser. No. 09/843,654 filed Apr. 26, 2001 now abandoned which claims the benefit of Provisional application No. 60/200,136 filed Apr. 27, 2000.

FIELD OF THE INVENTION

The present invention relates to windows and more particularly, relates to frames such as used for screening for windows.

BACKGROUND OF THE INVENTION

In modern day windows, a screen is usually provided as a part of the original window. The screen member must be lightweight and easily removable such that access may be had to the glass portion of the window. Traditionally, the screen member is formed by frame members along the top, bottom and sides, the frame members being joined together at the corners by suitable means. The joining at the corners may conveniently accomplished by means of a screen corner member.

A number of different types of corner members are known in the art. While they all perform the same function of attaching the frame members together, they do so in many different fashions.

There are also a number of different means for retaining the members in the window frame. To this end, many window frames provide a recess of one form or another designed to receive the window screen. In order to retain the screen in position, various types of locking members and/or spring members may be utilized. Since there are few standards which exist, each manufacturer generally adapts his own method for retaining the screen frames. As a result, independent suppliers of the screens have to design and manufacture a number of different styles of screens and frames.

SUMMARY OF THE INVENTION

It is an object of the present invention to provide a novel frame for a screen using a screen corner member for attaching the structural components together and which also includes means for securing the screen in place.

It is also an object of the present invention to provide a novel spring member which is suitable for use in retaining a frame unit within a window frame.

According to one aspect of the present invention, there is provided a dome shaped spring member suitable for use in retaining a frame unit within a window frame, the spring member comprising an elongated dome portion terminating at first and second ends, the elongated dome portion having an outer convex surface and an inner concave surface, an upwardly extending portion extending outwardly from the outer convex surface, and means located at the first end for securing the spring member to a substrate.

According to a further aspect of the present invention, there is provided a screen frame unit comprising a top frame member, a bottom frame member and a pair of side frame members, the top, bottom and side frame members being interconnected by four corner members, each corner member having a corner portion and first and second legs extending outwardly from the corner portion, the first and second legs being mutually perpendicular, each of the legs fitting interiorly of a respective frame member to thereby form a rectangular screen frame unit, and a dome shaped spring member having an elongated dome portion terminating at first and second ends, the elongated dome portion having an outer convex surface and an inner concave surface, an upwardly extending portion extending outwardly from the outer convex surface, the spring member being secured between a frame member and a leg engaged therewith.

The frame unit for the screen is preferably comprised of four elongated frame members, four corner members for securing the frame members together, and at least one spring member designed to function together with at least one of the frame members and one of the corner members to exert a biasing force on the frame unit when inserted into a channel in a window frame.

The frame members per se are well known in the art and many different types may be utilized. It suffices to say that such elongated frame members are readily available in the commercial market and one skilled in the art can utilize the frame member best suited for the end purpose. The frame members can be made of different materials and are usually formed of a plastic or metallic material.

The corner member of the present invention, although it can be formed of many different materials, is preferably formed of an injection molded plastic material. As such, it can be fabricated any desired colour.

The corner member has a corner portion with a front and rear face, and with first and second exterior side walls extending therebetween. A protrusion is mounted on one of the side walls for locking the screen in place. Normally, the protrusion would be placed on the exterior side wall which ends either in the top facing direction or the bottom facing direction. In other words, the protrusion may be formed on only one of the side walls extending between the front and rear faces of the corner portion.

Also, the corner member includes a lip which extends outwardly from the corner portion in the form of a flange. The lip or flange may extend as a portion of the rear face or alternatively, it may be offset with respect to the rear face. The particular design will vary depending upon the design of the window unit for receiving the screen.

The protrusion may be of any desired configuration and conventionally, may be formed either in a semi-circular configuration, a rectangular or triangular configuration.

There is also provided at least one spring member which is designed to retain the frame in position. The spring member may be used in conjunction with the protrusion mentioned above. As such, the spring member would be designed to fit within a channel and bias the frame and protrusion into its desired position. Thus, the screen frame would be securely retained in place.

The spring member is a dome shaped spring and may be made of a suitable plastic or metallic material.

The spring member is designed to fit within a recess within the frame of the window designed to receive the screen. Typically, such recesses are formed of varying dimensions. With the present invention, one can use a single spring member which would be suitable for many different sizes of recesses.

The outwardly extending portion from the dome portion may, in the case of a metallic material, be formed by cutting a pair of slits in the material and, using a suitable tool, forming the outwardly extending portion. Alternatively, in the case of a plastic spring, the outwardly extending portion may be molded as a part of the spring.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1A:
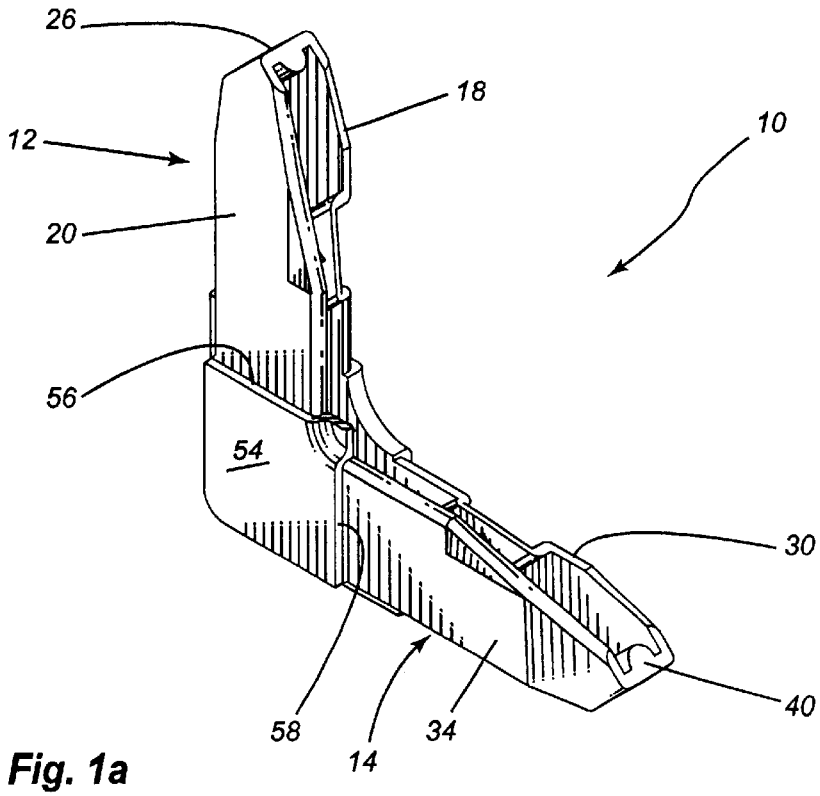
FIG. 1*a* is a perspective view of a corner member according to an embodiment of the present invention.

Referring to the drawings in greater detail and by reference characters thereto, there is illustrated a corner member generally designated by reference numeral 10 and which corner member 10 is suitable for use in connecting a pair of frame channel members together.

Corner member 10 includes an upper leg 12 and a lower leg 14. It will be understood that the terms "upper" and "lower" are used merely for purposes of description and that the piece will have many different orientations depending upon the placement thereof.

Figure 1B:
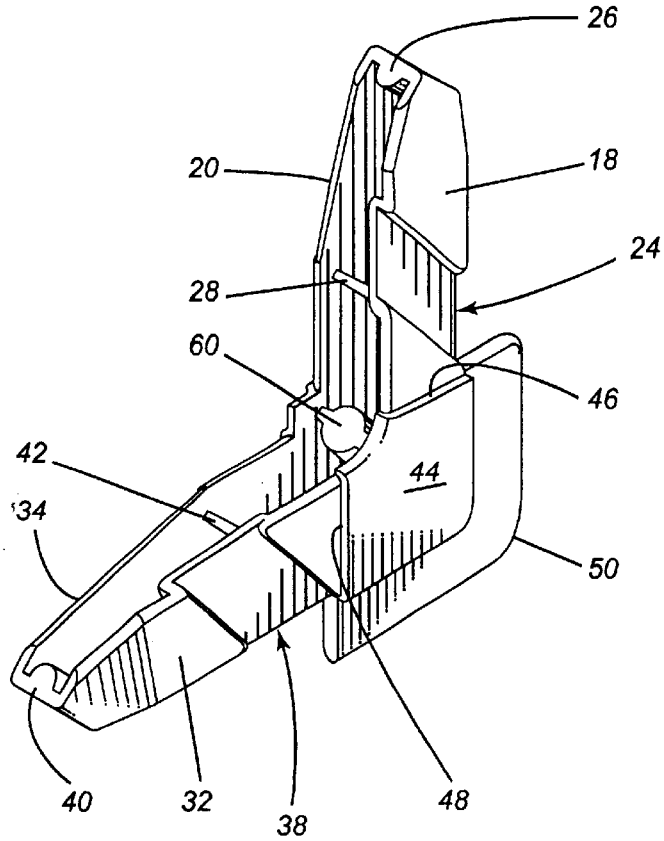
FIG. 1*b* is a perspective view from the opposite side thereof.
Figure 5:
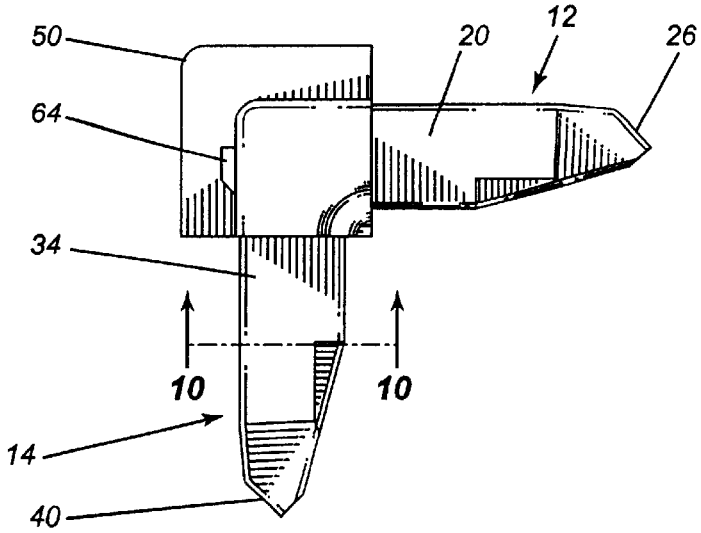
FIG. 5 is a side elevational view with the member rotated 90° from that shown in FIG. 2.
Figure 3:
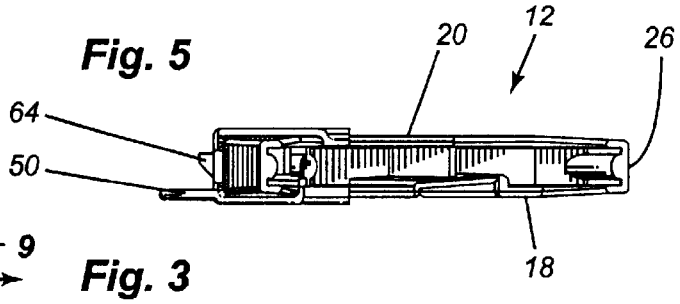
FIG. 3 is a top plan view thereof.
Figure 6:
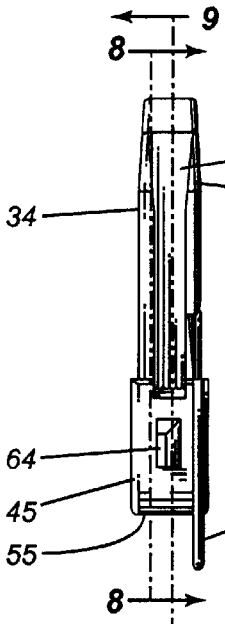
FIG. 6 is a end elevational view.
Figure 2:
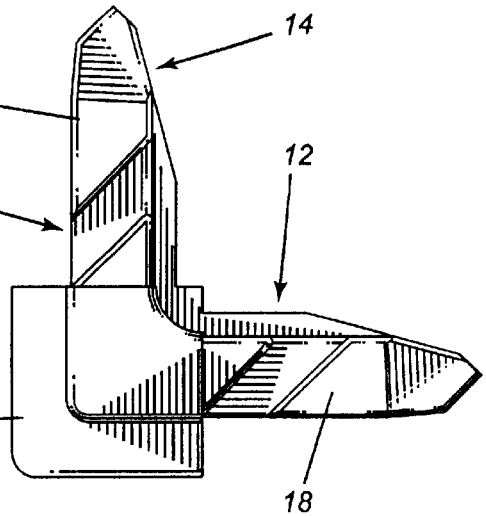
FIG. 2 is a side elevational view thereof.
Figure 7:
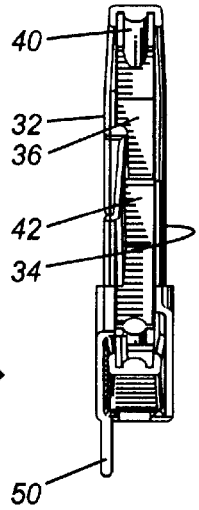
FIG. 7 is a top plan view.
Figure 4:
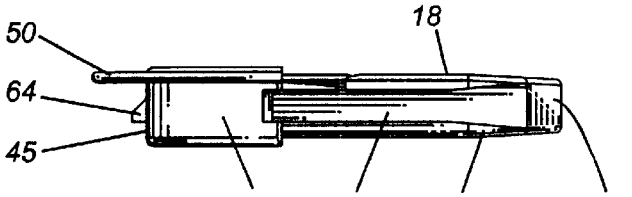
FIG. 4 is a an end elevational view thereof.
Figure 8:
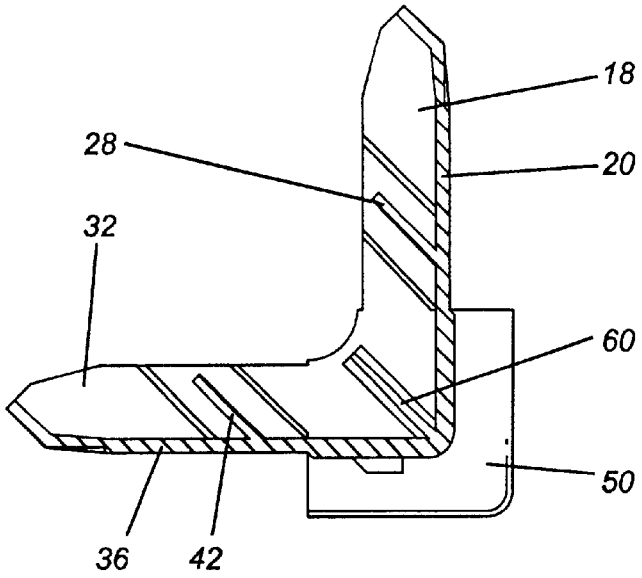
FIG. 8 is a sectional view taken along the lines 8—8 of FIG. 6.
Figure 9:
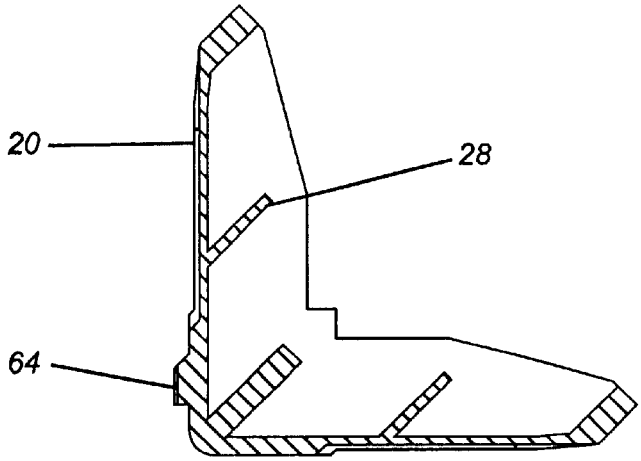
FIG. 9 is a cross sectional view taken along the lines 9—9 of FIG. 6.
Figure 10:
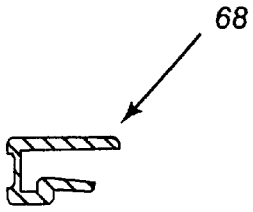
FIG. 10 is a cross sectional view of a spring member.

Upper leg 12 includes an upper leg inner side wall 18 and an upper leg outer side wall 20 having an upper leg back wall extending therebetween. As may be seen in FIG. 1*b* and FIG. 2, a diagonally extending recess 24 is formed in upper leg inside wall 18. At their distal ends, upper leg inside wall 18, upper leg outer side wall 20 along with upper leg back wall 22 form an inwardly extending portion generally designated by reference numeral 26. A recess 25 is formed in back wall 22 and forms a notch 27. A reinforcing rib 28 extends from upper leg back wall 22 and between upper leg inner side wall 18 and upper leg outer side wall 20.

Similarly, lower leg 14 includes a lower leg inner side wall 32, and a lower leg outer side wall 34 and a lower leg back wall 36 extending therebetween. A recess 38, which recess 38 extends diagonally, is formed in lower leg inner side wall 32. A recess 33 is formed in back wall 32 and also forms a notch 35. As was noted with respect to upper leg 12, lower leg 14 also includes an inwardly extending portion 40 at the distal ends of walls 32, 34 and 36. A rib 42 is also formed between the walls.

Between upper leg 12 and outer leg 14 and in particular, between inner side wall 18 and inner side wall 22, there is provided a corner portion having a rear face 44 and a front face 54. Rear face 44 has an upper abutment surface 46 and a lower abutment surface 48 which are designed to abut against the end walls of a channel containing the screening. It will be noted that there is provided a lip 50 extending from rear face 44. Similarly, front face 54 has an upper abutment surface 56 and a lower abutment surface 58.

Extending between rear face 44 and front face 54 is an inner central reinforcing rib generally designated by reference numeral 60 and first and second exterior walls 45 and 55.

The corner 10 also includes a locking protrusion 64 which extends downwardly from side wall 45 and is designed to lock in the channel of a frame for receiving the screen. There is also provided a first type of spring member 68 which is designed to fit within recess 25 or 33 in the back wall and exert a biasing force on the finished screen frame unit to retain the same in position and to maintain locking protrusion 64 in the desired position and prevent the screen from falling out of the frame.

Figure 11:
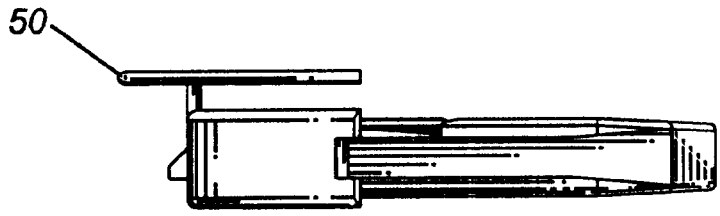
FIG. 11 is a partial cross sectional configuration illustrating an offset lip arrangement.

As seen in the embodiment of FIG. 11, lip 50' may be offset with respect to rear face 44'.

Figure 12A:
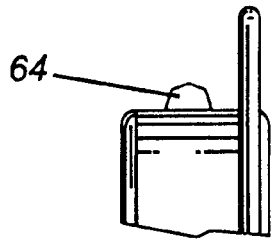
FIGS. 12*a* to 12*c* illustrate different configurations of the protrusions.
Figure 12B:
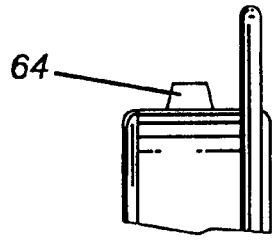
Figure 12C:
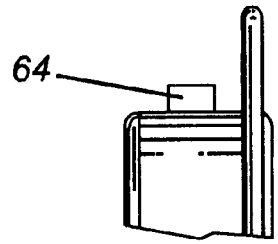

In FIGS. 12*a*, 12*b* and 12*c*, various configurations of locking protrusion 64 are shown. It will also be understood that locking protrusions 64 may be placed at different locations.

Figure 13:
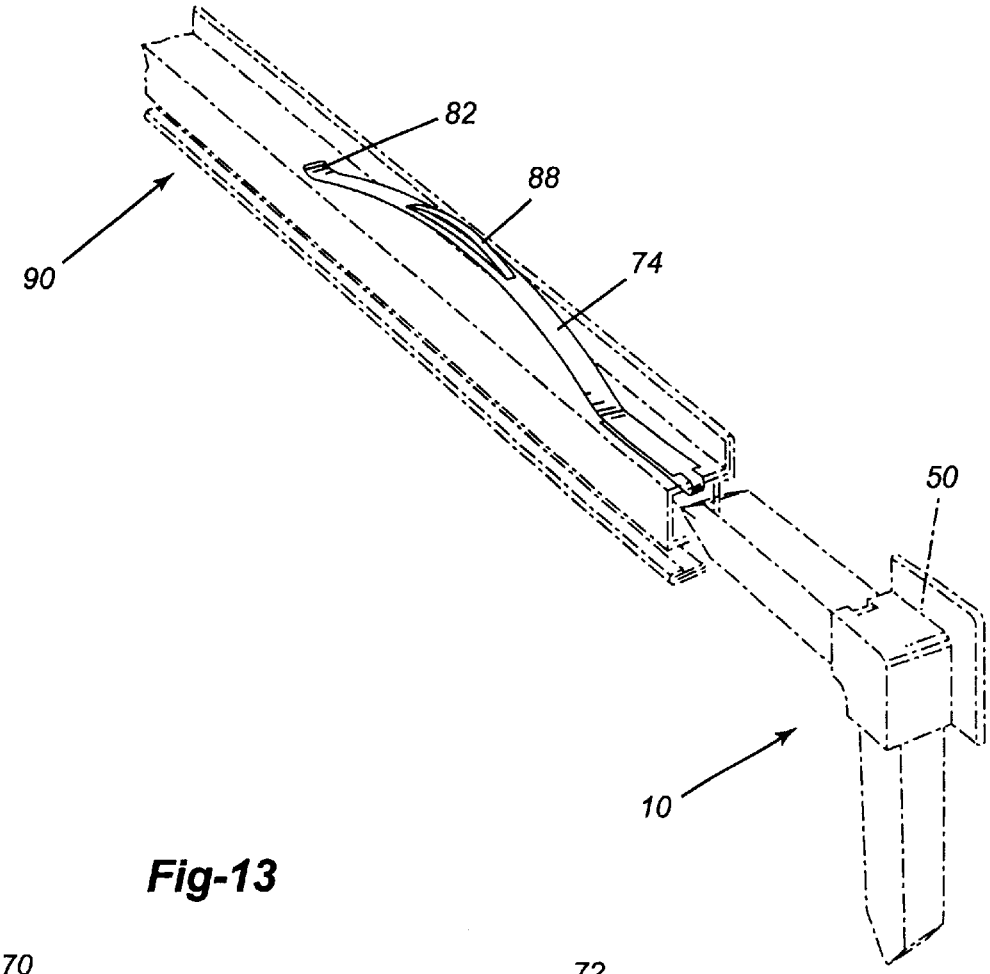
FIG. 13 is a perspective view of a spring member according to the present invention utilized in conjunction with a framing member and corner member.
Figure 14:
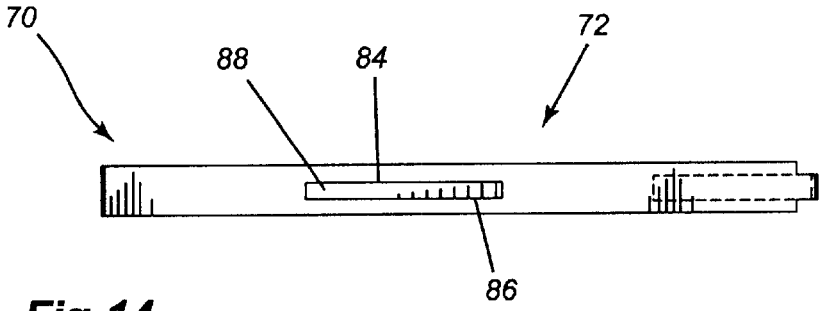
FIG. 14 is a top plan view of the spring member.
Figure 15:
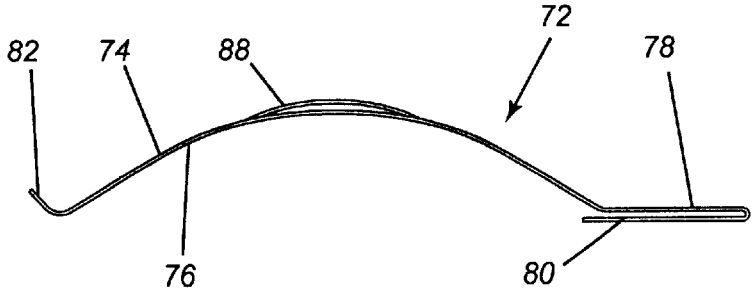
FIG. 15 is a side elevational view thereof.
Figure 16:
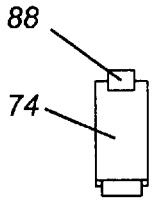
FIG. 16 is an end view thereof.
Figure 17:
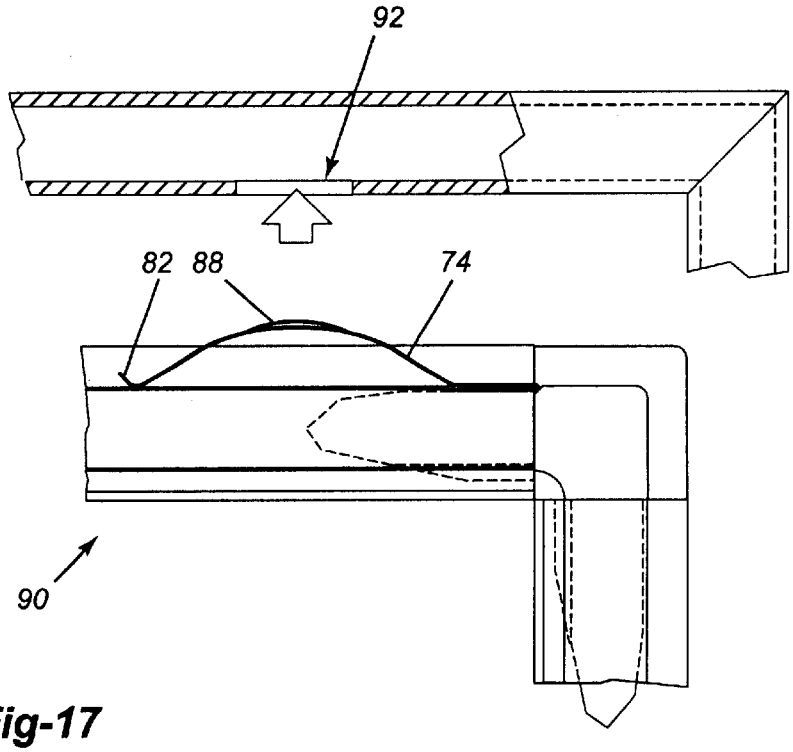
FIG. 17 is a side elevational view showing a portion of a screen frame member being placed in a window frame.
Figure 18:
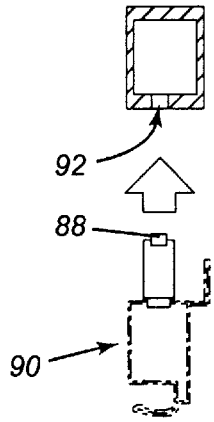
FIG. 18 is a sectional view thereof.
Figure 19:
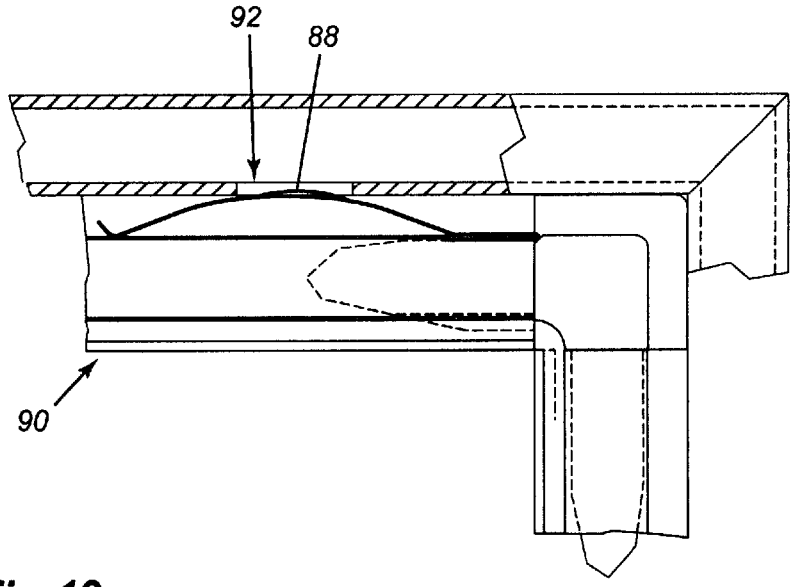
FIG. 19 is a side elevational view showing the placement of the screen frame within the window frame.
Figure 20:
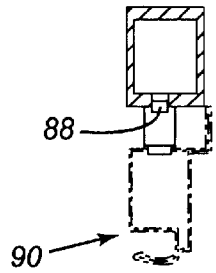
FIG. 20 is a cross sectional view thereof.

Referring to FIG. 13, there is illustrated a preferred form of the spring member as may be used with the corner member and associated frames. The spring member which is generally designated by reference numeral 70, has a dome shaped portion 72. Dome shaped portion 72 has a convex outer surface 74 and a concave inner surface 76. Reference to the terms "outer" and "inner" again are relative and refers to their positioning with respect to the screen frame.

At one end of dome portion 72, there is provided a first end outer portion 78 which is planar and which is connected by means of a fold to a planar first inner end portion 80. At the other end of dome portion 72, there is provided a second end portion 82.

Formed within dome portion 72 are a pair of slits 84 and 86 which define therebetween an upwardly extending portion 88. Upwardly extending portion 88 is formed to extend beyond convex surface 74 for reasons which will become apparent hereinbelow.

As may be seen in FIG. 13, a corner 10 is used to connect screen frames 90 (only one shown) and spring member 70 is inserted on frame 90 with a wall of the frame member being reduced to slide between planar portions 78 and 80. Groove 25 receives planar end portion 80 and notch 27 receives the end portion thereof.

When the screen frame is placed within a window frame, there is typically a recess such as designated by reference numeral 92 into which upwardly extending portion 88 will fit. The pressure exerted on dome portion 72 will cause upwardly extending portion 88 to extend even further outwardly to permit a secure retention of the screen frame.

It will be understood that the above described embodiment is for purposes of illustration only and that changes and modifications may be made thereto without departing from the spirit and scope of the invention.

I claim:

1. A screen frame unit comprising a top frame member, a bottom frame member and a pair of side frame members, said top, bottom and side frame members being interconnected by four corner members, each corner member having a corner portion and first and second legs extending outwardly from said corner portion, said first and second legs being mutually perpendicular, each of said legs connecting to a respective frame member to thereby form a rectangular screen frame unit, and a dome shaped spring member having first and second end portions with an elongated dome portion terminating at said first and second end portions, said elongated dome portion having an outer convex surface and an inner concave surface, an upwardly extending portion extending outwardly from said outer convex surface, a first end portion of said spring member being secured between a frame member and a leg engaged therewith.

2. The screen frame unit of claim 1 wherein said spring member is formed of a metallic material.

3. The screen frame unit of claim 1 wherein said spring member is formed of a molded plastic material.

4. The screen frame unit of claim 2 wherein said upwardly extending portion is defined by a pair of parallel slits formed in said elongated dome portion.

5. The screen frame unit of claim 2 wherein said first end portion has first and second co-planar portions forming a clip like configuration to receive a substrate therebetween.

6. In a window frame having a window frame portion designed to receive a screen frame unit, the improvement wherein said screen frame unit comprises a top frame member, a bottom frame member and a pair of side frame members, said top, bottom and side frame members being interconnected by four corner members, and a dome shaped spring member having first and second end portions with an elongated dome portion terminating at said first and second end portions, said elongated dome portion having an outer convex surface and an inner concave surface, an upwardly extending portion extending outwardly from said outer convex surface, said upwardly extending portion fitting within an opening in said window frame portion to thereby secure and locate said screen frame unit.

7. The improvement of claim 6 wherein said spring member is formed of a metallic material.

8. The improvement of claim 6 wherein said spring member is formed of a molded plastic material.

* * * * *